US006662988B2

(12) United States Patent
Eigenmann

(10) Patent No.: US 6,662,988 B2
(45) Date of Patent: Dec. 16, 2003

(54) APPARATUS FOR A STEPWISE FEEDING OF A STRIP-SHAPED ARTICLE

(75) Inventor: Oskar Eigenmann, Arbon (CH)

(73) Assignee: Bruderer AG, Frasnacht (CH)

( * ) Notice: Subject to any disclaimer, the term of this patent is extended or adjusted under 35 U.S.C. 154(b) by 0 days.

(21) Appl. No.: 10/223,595

(22) Filed: Aug. 15, 2002

(65) Prior Publication Data

US 2003/0075580 A1 Apr. 24, 2003

(30) Foreign Application Priority Data

Oct. 18, 2001 (EP) ..... 01 124 281

(51) Int. Cl.[7] ..... B65H 20/00; B65H 23/06

(52) U.S. Cl. ..... 226/142; 226/150; 226/151; 226/154; 226/179; 226/188

(58) Field of Search ..... 226/108, 115, 226/141, 142, 150, 151, 154, 177, 179, 188

(56) References Cited

U.S. PATENT DOCUMENTS 3,758,011 A * 9/1973 Potmann ..... 226/142
3,784,075 A * 1/1974 Portmann ..... 226/154
4,415,108 A * 11/1983 Katoh ..... 226/154
5,026,336 A * 6/1991 Messner ..... 226/154
5,102,026 A * 4/1992 Messner ..... 226/154
5,163,595 A * 11/1992 Messner ..... 226/154
5,358,164 A 10/1994 Messner
5,806,745 A * 9/1998 Irwin ..... 226/179

FOREIGN PATENT DOCUMENTS

DE 2241686 4/1973
JP 63207431 8/1988

OTHER PUBLICATIONS

Patent Abstracts of Japan of JP 63207431 Dated Aug. 26, 1988.

* cited by examiner

*Primary Examiner*—Michael R. Mansen
(74) *Attorney, Agent, or Firm*—Ladas & Parry

(57) ABSTRACT

Two intermittently and oscillating driven feeding rollers (2; 3) are adapted to feed a strip-shaped workpiece (63). The bottom feeding roller (2) is supported in the frame (1) of the feeding device. The upper feeding roller (3) is supported in a rocker (30). The movement of the rocker (30) is controlled by a control disk (64) through a lever and a rod arrangement (40). The rocker (30) rests at one end (33) via a pressure spring (39) against the frame (1). At the opposite end (34) the rocker (30) rest against the frame (1) via a further pressure spring (36). The rocker (30) is supported in an overhung state on a cantilever which consists of a sleeve (70), a arm (71) projecting laterally from the sleeve (70) and a shaft (72) held clamped in the arm (71). The clamping bar (46) is firmly mounted to the shaft (72).

19 Claims, 6 Drawing Sheets

APPARATUS FOR A STEPWISE FEEDING OF A STRIP-SHAPED ARTICLE

CROSS REFERENCE TO RELATED APPLICATIONS

This application claims the priority from the European Patent Application No. 01 124 281.5, filed on Oct. 18, 2001, of which the entire disclosure shall be considered to be included in the present application by reference.

BACKGROUND OF THE INVENTION

1. Field of the Invention

The present invention relates to an apparatus for a stepwise feeding of a strip-shaped article. It also relates to twin feeding apparatuses for a stepwise feeding of at least one strip-shaped article and including two feeding apparatuses of the kind set forth above.

2. Description of the Prior Art

Such apparatuses are used for instance for a stepwise feeding of a metal strip to and through a press, specifically a punch press, in which punch press tools for processing such a metal strip for instance by punching, embossing, bending, riveting, and so on are installed.

The stepwise feeding of the strip-shaped article can proceed as is conventional by linearly oscillating gripper members or by oscillatingly rotating or intermittently rotating, resp. feeding rollers.

Depending from the product which is proceed in such punch presses, metal strips of various widths such as for instance in the range between about 20 Millimeters and 450 Millimeters are processed, and also simultaneously two such strips which are arranged side by side.

Accordingly, apparatuses for feeding such strips to and through a punch press must be of differing designs, depending from a respective strip or from respective strips which is or are, resp. to be processed so to be able to cope with the prevailing strip or strips, respectively. This results obviously in considerable production costs for a manufacturer because due a multitude of differently designed feeding apparatuses are needed.

SUMMARY OF THE INVENTION

Hence, it is a general object of the invention to provide an apparatus for a stepwise feeding of a strip-shaped article, which apparatus enables a feeding of strip-shaped articles, possibly in a twin design, of various widths, and also simultaneous feeding of two strip-shaped articles.

A further object of the invention is to provide an apparatus for a stepwise feeding of a strip-shaped article which apparatus has a frame, a first and a second feeding roller, which feeding rollers are adapted to receive between themselves the strip-shaped article to be fed, has a means for driving the two feeding rollers, which means are drivingly connected to the two feeding rollers and are adapted to drive the feeding rollers to oscillate and to contrarotate relative to each other, further having a rocker which has a first end and a second end located opposite of the first end, which first feeding roller is supported for rotation in the frame in a non displaceable state and which second feeding roller is supported for rotation in the rocker, which second feeding roller includes an axis, further has means for moving the rocker, which means are connected to the rocker and are adapted to move the rocker including the feeding roller supported therein towards to first feeding roller into a feeding position and away from the first feeding roller into a return position, which rocker moving means include a control means which communicates with the feeding roller driving means and includes a translatory moveable rod member guided for an upwards and downwards movement, which rod member is mounted to the first end of the rocker and is adapted to move the rocker together with the second feeding roller supported in same, which rocker moving means is adapted to move the second feeding roller at a point of time of a reversal of a first sense of rotation of the oscillating feeding rollers into the feeding position, and at a point of time of a reversal of a second sense of rotation of the feeding rollers into the return position, which second feeding roller includes an axis, has, furthermore, a first pressure spring having a first end and a second end, which pressure spring rests at its first end on the rocker at a point between the axis of the second feeding roller and the second end of the rocker, and rests at its second end opposite of the first end on the frame, which pressure spring is adapted to act onto the rocker from the same side as the rod member and in a direction substantially parallel to a direction of movement of the rod member, has, furthermore, a clamping bar mounted to the rocker and a stationary clamping bar counter member mounted to the frame, which clamping bar is biased by the first pressure spring against the stationary counter members in order to arrest a respective strip-shaped article when the second feeding roller is in its return movement position, and is lifted off the stationary counter member when the second feeding roller is in its feeding movement position, which rocker is supported one-sided for rotation in a cantilever structure which in turn is supported for rotation in a non displaceable state.

Still a further object of the invention is to provide a twin feeding apparatus which includes two feeding apparatuses having feeding rollers, which apparatuses face each other of the side of their feeding members.

The advantages of the invention are seen mainly in that the apparatus can be applied alone as single apparatus for a feeding of strip-shaped articles of various widths, but can also be applied in a twin arrangement having two such apparatuses facing each other for a parallel feeding of two adjacently located strip-shaped article, and allows also a twin apparatus arrangement in which the two single apparatuses are positioned at a considerable distance from each other, so that extremely broad strip-shaped articles may be fed and processes.

BRIEF DESCRIPTION OF THE DRAWINGS

The invention will be better understood and objects other than those set forth above, will become apparent when consideration is given to the following detailed description thereof. Such description makes reference to the annexed drawings, wherein.

DETAILED DESCRIPTION OF THE PREFERRED EMBODIMENTS

Figure 1:
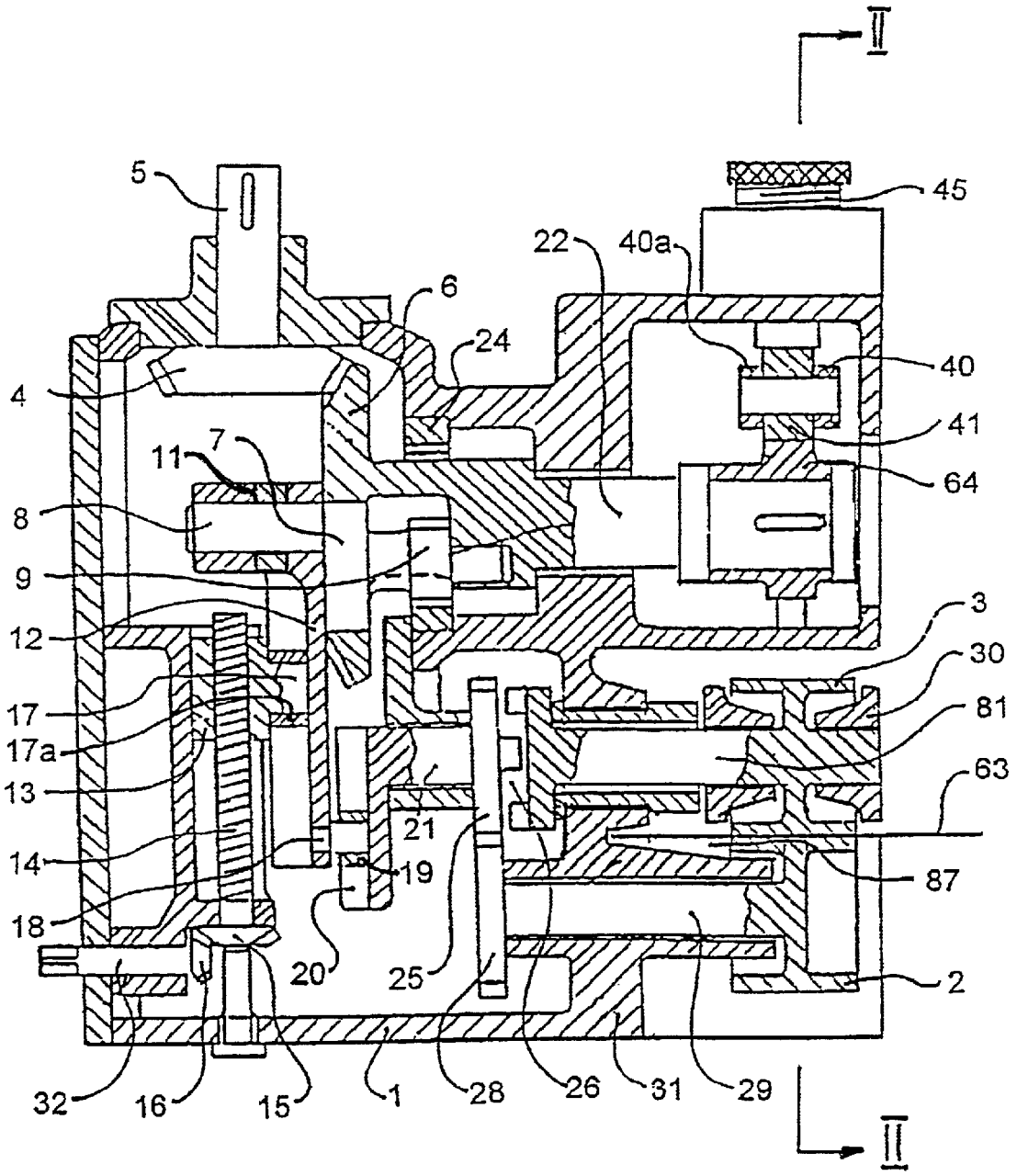
FIG. 1 illustrates a section through an apparatus for a stepwise feeding of a strip-shaped article structured in accordance with the present invention.
Figure 2:
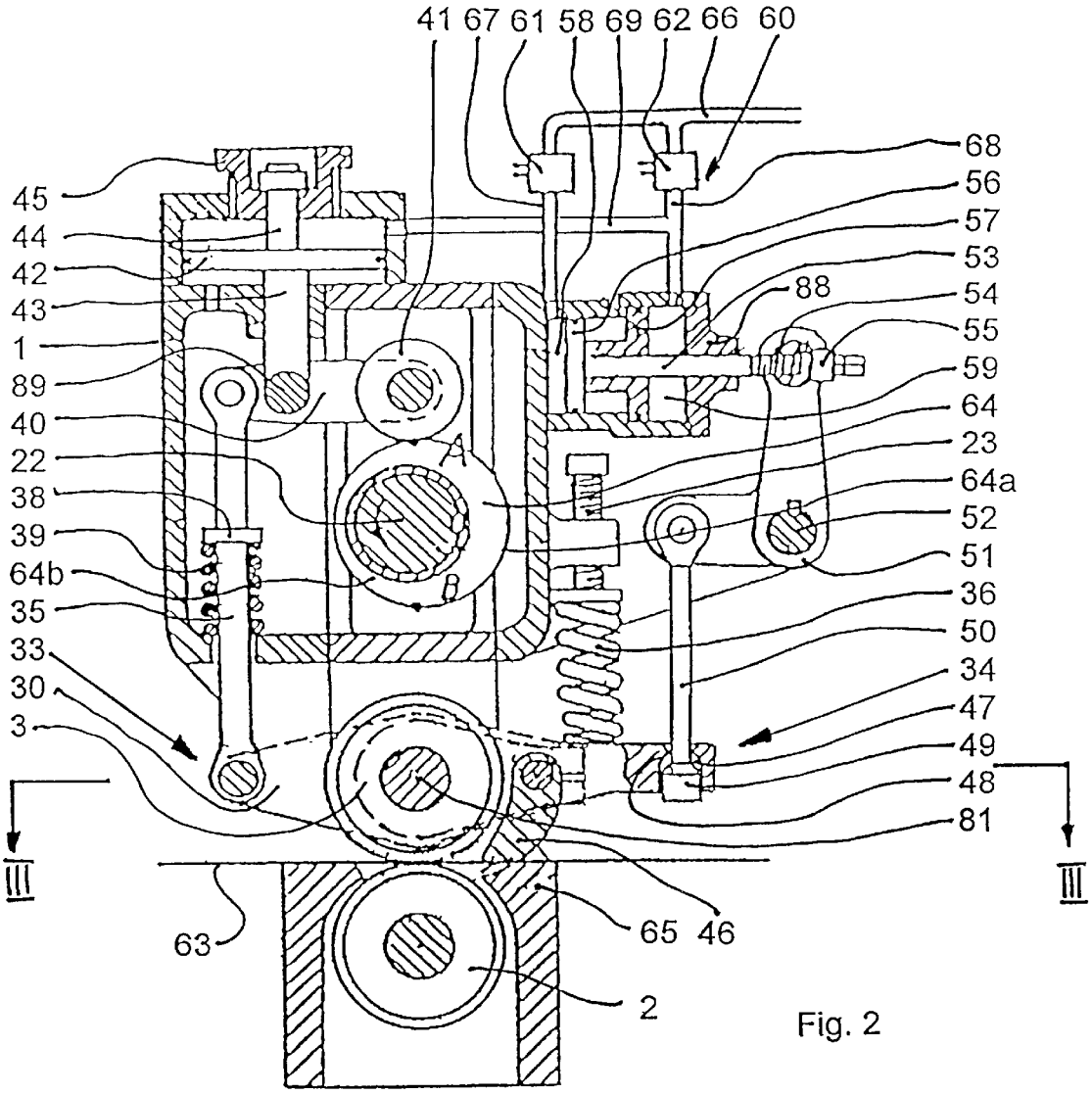
FIG. 2 illustrates a section along line II—II of FIG. 1.

The feeding apparatus illustrated in FIGS. 1 and 2 includes a frame 1. A first, lower feeding roller 2 and a second, upper feeding roller 3 are arranged in or at, respectively the frame 1. The first feeding roller 2 is supported for rotation in the frame 1 in a non displaceable state. The second feeding roller 3 is displaceable in a manner which will be described in detail further below.

These two feeding rollers are driven to oscillate.

Figure 9:
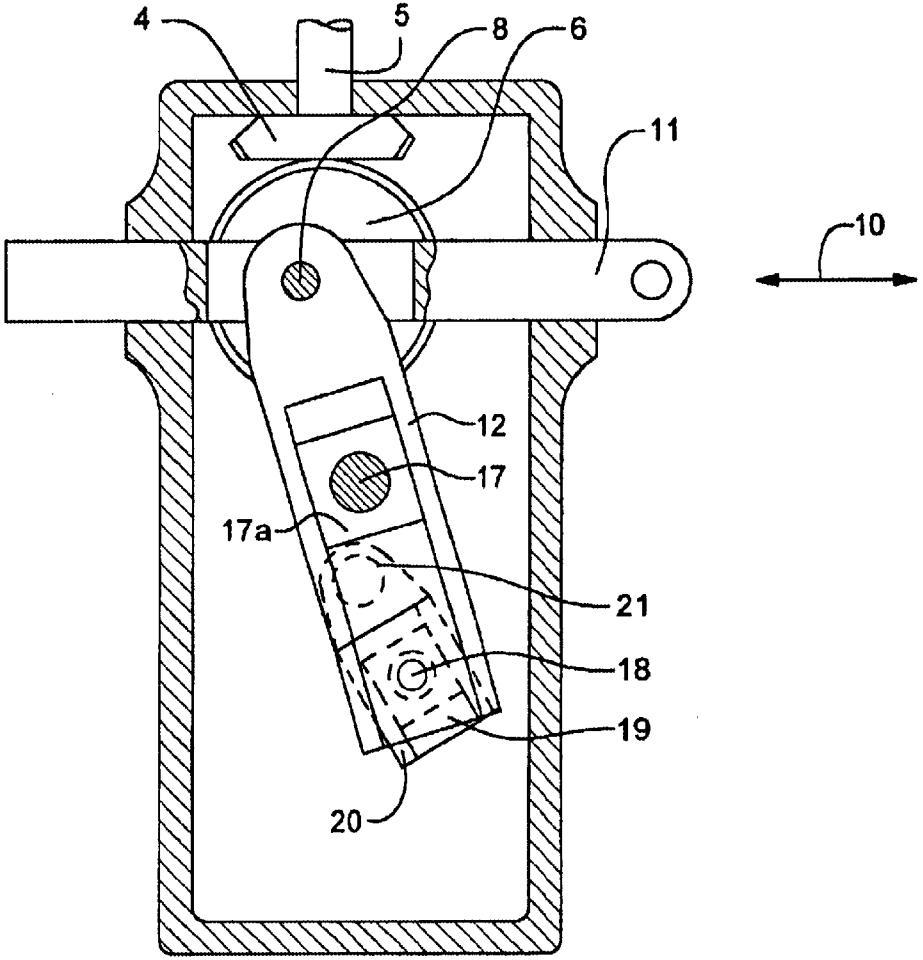
FIGS. 8 and 9 illustrate schematically the portion of the apparatus which includes the structural members for an oscillating driving of the feeding rollers.
Figure 8:
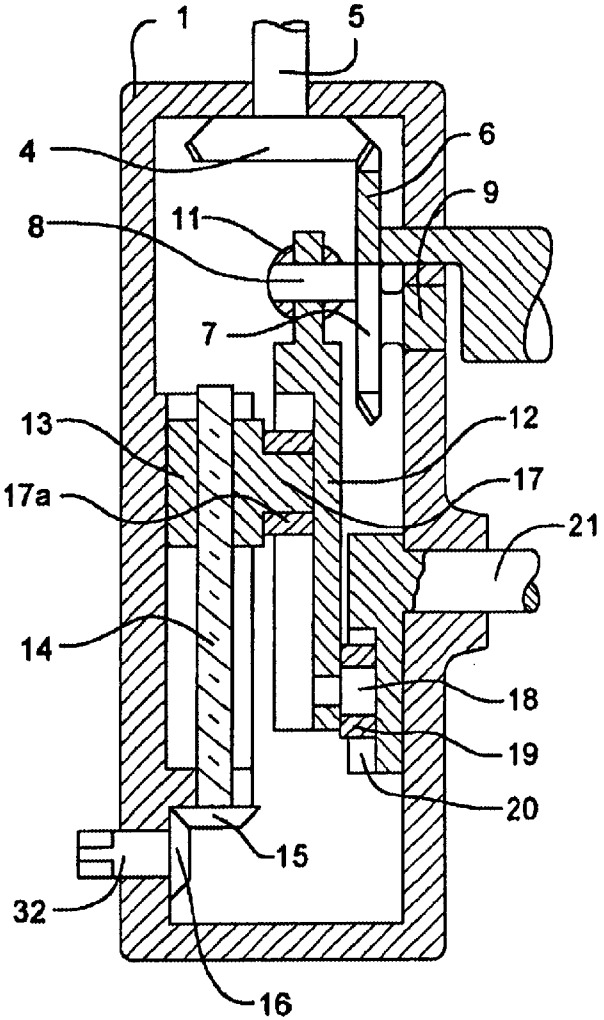

The operation of the drive for these two feeding rollers will now be described with reference to FIG. 1 and to FIGS. 8 and 9. FIG. 1 illustrates a section through the feeding apparatus. FIG. 8 illustrates schematically the portion of the apparatus which encompasses the structural members for an oscillating driving of the feeding rollers 2, 3. FIG. 8 is, thereby, to be compared with the left side of FIG. 1, whereby the illustration in FIG. 8 is simplified and schematically for an easy understanding of the disclosure. FIG. 9 is also a simplified side view of the structural elements illustrated in FIG. 8.

The driving of the feeding apparatus takes place by a drive member illustrated in FIG. 1 in form of a bevel gear 4. This bevel gear 4 is mounted to a shaft 5 which is adapted to be connected to a not particularly illustrated drive of a conventional design.

The bevel gear 4 meshes with a further bevel gear 6. A disk 7 is supported for rotation in this further bevel gear 6, which disk 7 is arranged eccentrically inside the further bevel gear 6. The disk 7 supports at one of its sides an eccentrically arranged pivot pin 8 and at the other side a spur gear wheel 9 which is arranged coaxial relative to the disk 7. This spur gear wheel 9 meshes with a ring 24 with an internal toothing.

The pivot pin 8 shown in FIG. 1 is now to be compared with the pivot pin 8 illustrated in FIGS. 8 and 9.

It is now obvious, that due to the eccentric arrangement of the disk 7 and of the gear wheel 9, the eccentrically arranged pivot pin 8 will perform in operation an oscillating movement (illustrated in FIG. 9 somewhat simplified). This oscillating movement is depicted in FIG. 9 by the double arrow 10. For reasons of this explanation it shall be assumed that the illustrated rod 11 is moved back and forth and in the direction of its longitudinal extent, that is in the direction of the double arrow 10, by a drive with an eccentric member or by a crank drive. The rod 11 which is moveable in the direction of its longitudinal extent drives an arm 12 which is pivotally mounted to the rod 11 by pivot pin 8.

This arm 12 is also illustrated in FIG. 1. The arm 12 is pivotally supported on the pivot pin 8. A threaded spindle 14 extends through a guiding block 13 with an internal thread and meshes with same. The guiding block 13 includes a pin 17, and the arm 12 is pivotally supported on this pin 17 through a slider 17*a*. The position of the pin 17 determines the respective pivotal point for a respective extent of the feeding movement. The guiding block 13 is, further more, secured at the frame 1 against a rotation.

If the threaded spindle 14 is rotated by a not illustrated drive through the shaft 32 and the bevel gears 15, 16, the guiding block, 13 is displaced along the spindle 14. Thus, quite obviously, the pivotal point of the arm 12 supported on the pin 17 is now displaced, too.

A pivot pin 18 is supported at the free end of the arm 12. This pivot pin 18 supports a slider 19 which is guided between the legs of a U-shaped arm 20. This arm 20 is mounted to a shaft 21 which is to be driven to oscillate. This shaft 21 is illustrated in FIGS. 8 and 9 and can also be seen in FIG. 1.

If the rod 11 is moved back and forth in the direction of the double arrow 10, the arm 12 will pivot reciprocally around the axis of the pivot pin 17 of the guiding block 13 which axis thus forms the pivot axis. The pivotal movement of the lower end of the arm 12 caused by mentioned movement is transmitted through the pivot pin 18 and the slider 19 which slides between the legs of the arm 20 onto this arm 20, wherewith the shaft 21 is driven to oscillate.

Such as already mentioned above, the pivotal point of the arm 12 can be adjusted by a rotating of the threaded spindle 14, so that the length of the lever arm 8–17 and of the lever arm 17–18 are changed, wherewith the magnitude of the amplitude of the end of the arm 12 which supports the slider 19 and accordingly the amplitude of the pivotal movement of the shaft 21 can be adjusted.

It is, thereby, important that the translatory movement of the rod 11 and the movement of the pivot pin 8 remain always the same independent from mentioned amplitude of the arm 12, so that accordingly the amplitude of the pivotal motion of the shaft 21 can be adjusted.

Due to mentioned arrangement of the slider 19 of the arm 12 it is achieved that the force exerted by the slider 19 onto the arm 12 acts always perpendicularly onto the arm 12. Accordingly, the arm 12 can sweep over a range of 180°.

Returning to FIGS. 1 and 2 it now will be described how the driving principle as explained above is applied to the drive of the two feeding rollers 2 and 3.

The earlier described further bevel gear 6 which meshes with the driving member, that is the bevel gear 4 which is mounted to the shaft 5, is mounted to a drive shaft 22.

It already has been mentioned that disk 7 is arranged eccentrically inside the further bevel gear 6 and is rotatable inside the further bevel gear 6. At one of its sides this disk 7 carries the eccentrically arranged pin 8 which is also illustrated in the FIGS. 8 and 9.

At its opposite side the disk 7 is mounted to coaxially arranged spur gear wheel 9. This gear wheel 9 meshes with ring 24 with internal toothing which ring 24 is fixed and set in the frame 1. When the drive shaft 22 rotates, the gear wheel 9 rolls along the internal toothing of the ring 24. The relation ship between the diameters of the rolling circle of the coaxial gear wheel 9 and of the ring 24 amounts to 1:2.

The arm 12 is supported on the pivot pin 8, see also FIGS. 8 and 9, which arm 12 is pivotally supported on the pivot pin 17 of the guiding block 13. It already has been mentioned that the guiding block 13 may be displaced by a rotating of the threaded spindle 14 as described earlier.

Still referring to FIG. 1, the arm 12 carries at its lower end the pivot pin 18 with the slider 19 which cooperates as described above with the arm 20. The arm 20 is mounted to the shaft 21. This shaft 21 is in turn mounted to a gear wheel 25. This gear wheel 25 is connected through a suitable coupling 26 to a shaft 81 which carries the second feeding roller 3.

The gear wheel 25 meshes with a further gear wheel 28 which is mounted to a shaft 29 which in turn carries the first feeding roller 2.

When the drive shaft 22 is driven through the bevel gear wheels 4 and 6 the spur gear wheel 9 which is guided by the disk 7 in the gear wheel 6 rolls along the inner toothing of the ring 24. Due to the already mentioned relation of the diameters of the rolling circles of gear wheel 9 and ring 24 of 1:2, the pivot pin 8, see also FIGS. 8 and 9, is rectilinearly moved back and forth between two end points, whereby this movement, such as explained with reference to FIGS. 8 and 9, remains always the same, independent from the position of the pivotal axis of the arm 12.

The oscillating rotary movement of the shaft 21 is accordingly transmitted to the two feeding rollers 2, 3 which accordingly are driven to oscillate in a counter-rotating manner, whereby upon one single revolution of the drive shaft 22 the feeding rollers perform one complete reciprocating back and forth movement.

Thus, in this described embodiment the above explained structural members identified by the reference numerals 7, 8, 9, 12, 13, 17, 18, 19, 20 form a means for driving the two feeding rollers 2, 3.

The first feeding roller 2 is supported through the shaft 29 in an overhung position in a supporting portion 31 of the frame 1. It is supported to rotate in the supporting portion 31 in a non displaceable state. The supporting portion 31 includes a recess 87 for the receipt of an edge portion of a strip-shaped workpiece to be fed or advanced, respectively by the feeding apparatus. The second feeding roller 3 is supported in a rocker 30. This rocker 30 has a first end 33 and a second end 34.

A translatoric moveable rod member 35 which can move up and down is pivotally mounted to the first end 33 of the rocker 30.

A first pressure spring 36 rests, furthermore, at one of its ends on the rocker 30 at a point between the shaft 81 of the second feeding roller 3 and the second end 34 of the rocker 30, and rests at its opposite end via an adjusting screw 23 on the frame 1. This first pressure spring 36 acts from the same side as the rod 35 onto the rocker 30 and substantially in a direction parallel to the direction of movement of the rod 35.

The rod 35 has a circumferentially extending collar 38. A second pressure spring 39 is arranged between this collar 38 and the frame 1. Because the rod 35 is pivotally mounted to the rocker 30, the rocker 30 rests accordingly at its first end 33 via this second pressure spring 39 against the frame 1.

This pressure spring 39 ensures at all condition of the apparatus the necessary pressing-on force of a roller 41 onto a cam 64 such as will be described later.

The rocker 30 is pivotally mounted at its first end 33 to the rod 35. This rod is in turn pivotally mounted to a lever pair 40, 40*a* which carries at its free and a roller 41 supported for rotation thereon. Thus, the rocker 30 communicates at its first end 33 with mentioned lever pair 40, 40*a*.

The lever pair 40, 40*a* is pivotally mounted to a piston rod 43 at a point between its point of connection to the rod 35 and the point of connection to the roller 41. This piston rod 43 is mounted to a piston 42. A bolt 44 is, furthermore, mounted to the piston 42, which bolt 44 coacts with an adjusting nut 45 having a height scale and which is screwed into the frame 1. The roller 41 cooperates with cam 64 located on the drive shaft 22.

As will be shown, the structural members identified in this embodiment by the reference numerals 35, 36, 38, 39, 40, 41, 64 form a means for lifting the rocker 30.

It already has been mentioned that the drive for the drive shaft 22 is coupled to the drive of the feeding rollers 2 and 3.

Figure 4:
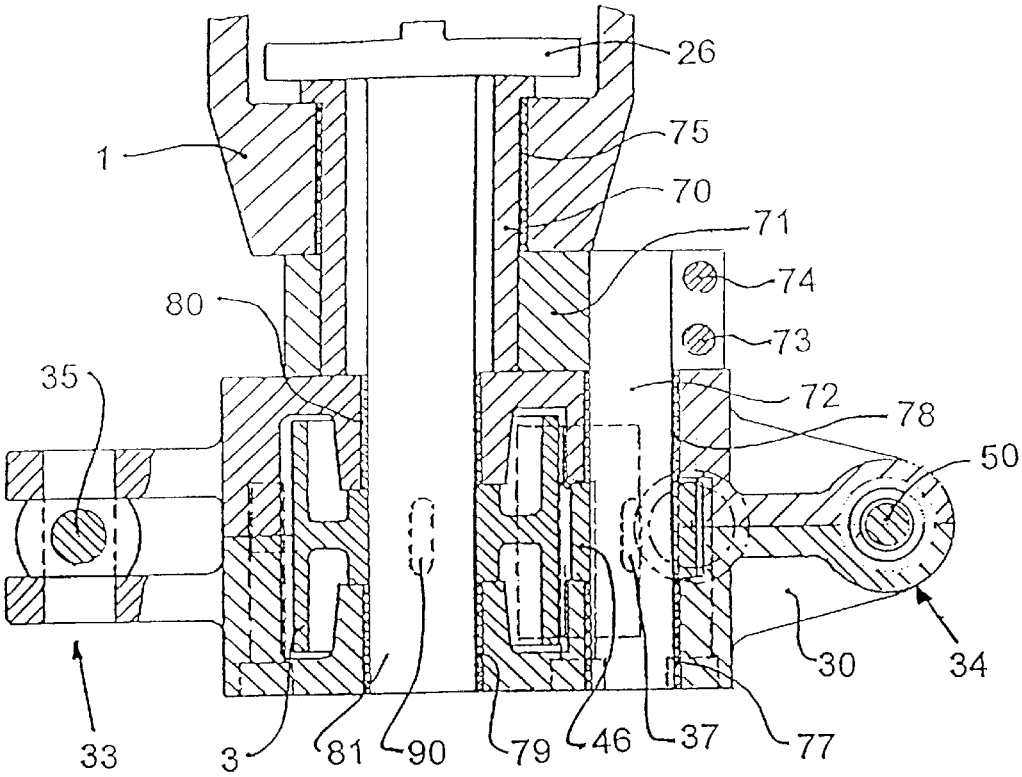
FIG. 4 is a illustration similar to FIG. 3, but for sake of clarity on a enlarged scale.
Figure 5:
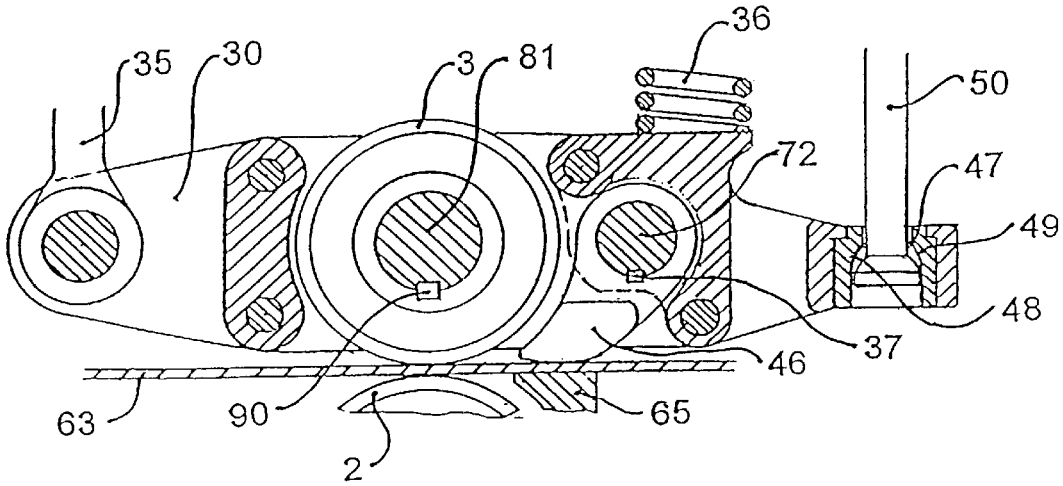
FIG. 5 is a side view of the rocker illustrated in FIG. 4.

A clamping bar 46 is arranged in the rocker 30. The clamping bar 46 is mounted to a shaft 72 such as will be described further below. To this end, a wedge 37 of a corresponding wedge and keyway connection is illustrated in FIGS. 4 and 5.

As has been described the rocker 30 rests at its second end 34 on spring 36. A recess 47 with a collar 48 which forms an abutment surface is arranged at the second end of the rocker 30. An abutment head 49 of a control rod 50 is located in this recess 47. This control rod 50 is pivotally mounted to a bell crank lever 51 which is supported at the frame 1 by the agency of a shaft 52. The bell crank lever 51 is mounted at its other end to a piston rod 53 which includes a thread 54 by means of which it engages a flange 55 of the bell crank lever 51.

The piston rod 53 is mounted to a first piston 56. This piston 56 is located in a chamber 58 of a cylinder 88. A second piston 57 is arranged on the piston rod 53, which second piston 57 can slide along the piston rod 53 and is located in a further chamber 59 of the cylinder 88, which second piston 57 has a larger diameter than the first piston 56. The transition from chamber 58 in which the first piston 56 moves to the chamber 59 with the second piston 57 is designed on an abutment for the second piston 57. Both chambers 58, 59 are connected to the infeed lines 60 of a pneumatic system. Piston 42 communicates also with this pneumatic system. Suitable control devices 61, 62 are built in the infeed lines 60.

Now, the stepwise feeding of a strip-shaped article, for instance a sheet metal web 63 will be described, which sheet metal web 63 is arranged between the two feeding rollers 2 and 3, thus at the area of the so-called bite of the feeding rollers 2 and 3. For ease of understanding the cam 64 is illustrated as being divided into two portions 64*a* and 64*b*. This division is identified by two diametrically opposite located points A and B. It is assumed furthermore, that the drive shaft 22 rotates counter-clockwise.

When the roller 41 rolls at the point A onto the portion 64*a* of the cam 64, the roller 41 will be lifted by the cam portion 64*a*. The rod 35 is accordingly moved downwards and presses the rocker 30 against the force of the spring 39 downwards. Due to the force which is exerted by the rod 35 onto the first end 33 of the rocker 30, the rocker 30 is pivoted downwards at the point of the connection between the rod 35 and the rocker 30. The upper, thus second feeding roller 3 is pressed against the lower, thus first feeding roller 2 which is supported in a non-displaceable state, i.e. which is stationary. The upper feeding roller 3 lies now on the sheet metal strip 63. Because the point of contact between the upper feeding roller 3 and the sheet metal strip 63 acts at this point of time as pivotal point of the rocker 30, the clamping bar 46 is lifted off the sheet metal strip 63. The two feeding rollers 2 and 3 which rotate at this time in the direction of the feeding movement engage the sheet metal strip 63 and feed it forwards. After a revolution of the drive shaft 22 by 180°, during which time span the cam portion 64*a* acts onto the roller 41, the cam portion 64*b* begins to act onto the roller 41 at point B. The springs 36 and 30 cause now the rocker 30 to pivot around the axis of the upper, second feeding roller 3 and a lifting of the rod 35 which causes the lever pair 40, 40*a* to pivot and causes a downwards movement of the roller 41. This downwards movement of the roller 41 is possible because the distance between the control surface portion of the cam portion 64*b* and the axis of the drive shaft 22 is smaller than the distance between the control surface portion of the cam portion 64*a* and the axis of the drive shaft 22.

The mentioned pivoting of the rocker 30 causes a lowering of the clamping bar 46, which presses the sheet metal strip 63 against the stationary abutment 65. Thus, the sheet metal strip 63 is firmly clamped. The stationary abutment 65 is a portion of the frame 1 of the feeding apparatus. After the sheet metal strip 63 has been clamped as described above, the upper, second feeding roller 3 is lifted. The point of contact clamping bar 46 sheet metal strip 63 becomes now the pivotal point of the rocker 30 connected via the shaft 72 to the clamping bar 46. The two feeding rollers 2 and 3 do not act any longer onto the sheet metal strip 63 and during the continued rotating of the drive shaft 22 the feeding rollers 2 and 3 perform by a further 180° their return movement which is opposite to this feeding movement. When after a complete revolution of the drive shaft 22 the composition 64*a* begins again to act onto the roller 41 at the point A, the feeding cycle is again initiated in that the feeding rollers 2 and 3 are again pressed against each other and clamping bar 46 is lifted off.

The cam 64 must be of such a design that the feeding rollers 2 and 3 are pressed towards each other and moved away from each other, respectively precisely at the point of time of the change of their oscillating movement, and specifically in synchronism with the lifting and pressing, resp. movement of the clamping bar 46.

In order to ensure a correct performance of the feeding apparatus at various thicknesses of the articles to be fed, the height position of the pivotal point of the lever pair 40, 40*a* can be adjusted by a adjusting of the position of the adjusting nut 45.

The length of feed is adjusted by adjusting the amplitude of the oscillating movement of the feeding rollers, that is as mentioned by a displacing of the guiding block 13 along the spindle 14.

The positions of the rocker for various states of operation which now will be described are controlled by a pneumatic control. A pressurized medium, here pressurized air, is fed from a source of pressurized air through the feed line 66. This feed line 66 is branched into two branch lines 67, 68. The control devices 61, 62 are arranged at these branch lines 67, 68.

A connecting line 69 is branched off the branch line 68 at a point downstream of the control device 62, which connecting line 69 extend to the cylinder chamber above the piston 42.

With regard to the pneumatic controlling of the feeding apparatus one generally can differentiate between two setting up states and two operating states. During the setting up states during which the operating members are in their setting up positions, the feeding apparatus and obviously the punch press which operates together with the feeding apparatus are at rest, as a rule in the range of the upper dead point. The roller 41 is situated at this state of the highest point of the cam 64 between the points A and B.

During the operating states, during which the various operating members act into the sheet metal strip to be fed and during which obviously the punch press with which the feeding apparatus cooperates is in operation, the drive shaft rotates in the direction identified by the arrow illustrated in FIG. 2.

In the first setting up position the upper feeding roller 3 and the clamping bar 46 are in a lifted position. This means that the upper feeding roller 3 is lifted off the lower feeding roller 2 and that the clamping bar 46 is lifted off the abutment 65.

When mentioned members are in the indicated setting up positions, a new strip 63 can be slid into the feeding apparatus.

In order to move mentioned members into mentioned positions the chambers 59 of the cylinder 88 and the chamber above the piston 42 are pressureless. Accordingly, the first end 33 of the rocker 30 which first end 33 is pivotally mounted to the spring loaded rod member 35 is lifted up by the action of the pressure spring 39.

At the same time the chambers 58 of the cylinder 88 is pressurized. Conclusively, the pistons 56 and 57 and the piston rod 53 are moved towards the right. The bell crank lever 51 is thus rotated and lifts the control rod 50 with its abutment head 49. Accordingly, the second end 34 of the rocker 30 is also lifted in that the abutment head 49 comes to contact the collar 48.

Therefore, the upper feeding roller 3 and the clamping bar 46, as well, are lifted.

In the second setting up position the upper feeding roller 3 is lifted off and the clamping bar 46 is pressed onto the slid in strip 63, that is towards the abutment 65.

In this setting up position the strip 63 which has been slid in is arrested by the clamping bar 63, for instance for further setting up procedures.

In order to arrive at these positions of mentioned members the chamber 59, the chamber above the piston 42 and the chamber 58, as well, are pressureless. Accordingly, the second end 34 of the rocker 30, at which end the control rod 50 engages the rocker 30 is lowered by the action of the spring 36. The rod 50 is, thus, pulled down and the bell crank lever 51 is rotated accordingly and conclusively the piston rod 53 with the piston 56 are moved towards the left because the chamber 58 is pressureless. So, the upper feeding roller 3 is lifted and the clamping bar 46 is pressed down.

The first operating state is applied when the tool which is mounted in the punch press to which the metal strip is fed by the feeding apparatus has no positioning pins for a precise positioning of the strip 63 during the processing of the strip 63, for instance during a punching operation. The use of positioning pins is well known in the art and thus must not be explained in detail. In this operating state the strip 63 is continuously positioned and arrested, that is in any operating position of the strip processing members of the punch press with which the feeding apparatus cooperates, either by the feeding rollers 2 and 3 or by the clamping bar 46 and the abutment 65.

Thus, the strip 63 is never loose.

Hereto, the chamber 59 and the cylinder chamber above the piston 42 are pressurized and the chamber 58 is pressureless.

Since the chamber 58 is pressureless, the second end 34 of the rocker 30 can not rest on the control rod 50, because the control rod 50 can move the piston 56 by the bell crank lever 51 and the piston rod 53 towards the left. Conclusively, in the lower dead point position of the feeding apparatus that is when the roller 41 is located at the lowermost surface area of the cam 64, the clamping bar 46 is held pressed against the strip 63 and arrests the strip 63.

The second operating state is applied when the tool mounted in the punch press includes positioning pins for a precise positioning of the strip 63 during its processing, for instance during a punching operation. In this state the strip 63 is exclusively positioned and arrested by the positioning pins during the acting of the tools on the strip 63. By means of such a procedure also a summarizing of feeding distance errors is avoided.

To this end, the strip 63 must lie loose after the conical positioning pins have penetrated the strip.

Hereto, the chamber 59, the cylinder chamber above the piston 52 and the chamber 58 are pressurized.

Before the roller 41 comes to rest on the lowermost point of the cam 64, the rocker 30 will come to rest at its second end 34, specifically the shoulder 48 on the abutment head 49 of the now stationary control rod 50, which is stationary locked because the above mentioned chambers are pressurized.

The roller 41 moves now towards the lowermost point of the cam 64 and before the roller 41 comes to rest on precisely the lowermost point of the cam 64, the rocker 30, as mentioned, comes to lie at it second end 34 via the shoulder 48 on the resting head 49 of the stationary control rod 50.

Therefore, this location will now be the pivotal point for the now following pivotal movement of the rocker 30.

Thus, during the moving of the roller 41 towards the lowermost point of the cam 64, the first end 33 of the rocker 30 is lifted further by the rod 35, and accordingly the upper feeding roller 3 and the clamping bar 46 will be lifted further during the pivoting movement of the rocker 30 until the roller 41 had reached the lowermost point of the cam 64.

And conclusively, the strip 63 is now completely loose.

The precise point of time of this described lifting is set at the thread 54 by the nut 55 so that the bell crank lever 51 is rotated and accordingly the position of the rod 50 is adjusted.

Figure 3:
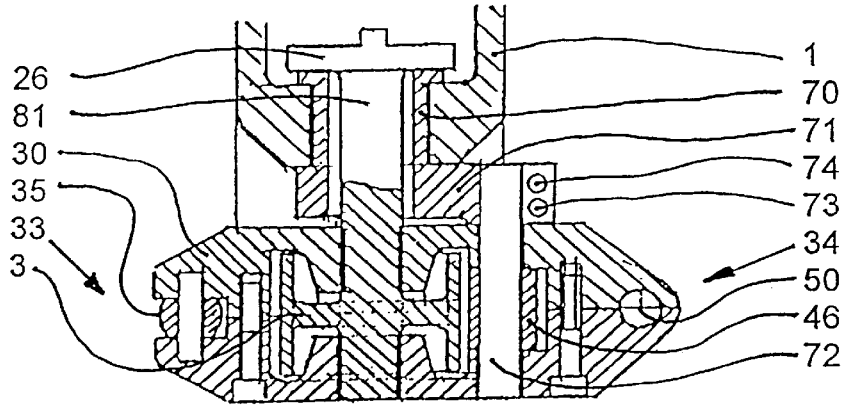
FIG. 3 illustrates a section along line III—III of FIG. 2.

Reference is now made specifically to FIGS. 3, 4 and 5. The rocker 30 is supported to rotate in an overhung state on a cantilever.

This cantilever includes a sleeve 70 which is supported for free rotation in a bearing 75 set into the frame 1. The sleeve 70 is firmly mounted to a arm 71 by means of a press fit so to rotate with the arm 71. The arm 71 projects laterally from the sleeve 70. A shaft 72 which extends parallel to the sleeve 70 is releasably clamped in the arm 71. To this end the arm 71 is slit at its end remote from the sleeve 70. Clamping screws 73 and 74 extend through the slit end portion of the arm 71.

The rocker 30 is in turn mounted for rotation on the shaft 72 through bearings 77 and 78.

The upper, second feeding roller 3 is supported through bearings 79 and 80 in the rocker 30. The feeding roller 3 sits on a shaft 81 which extends coaxially through the sleeve 70. The reference numeral 90 denotes the wedge of a corresponding wedge and keyway connection. The shaft 81 ends at the coupling part 26.

As clearly can be seen, the outer diameter of the shaft 81 is smaller than the inner diameter of the sleeve 70. This means that when the rocker 30 moves, the shaft 81 can move freely in a radial direction inside of the sleeve 70.

The clamping bar 46 is firmly mounted to the shaft 72.

The changing instant of the resting or pressing, resp. states between the roller 3 and the clamping bar 46 proceeds at the position of the cam as illustrated in FIG. 2. In this position the timing of the lifting (basic setting) can be set precisely by a rotating of the shaft 72 in the arm 71. During this setting both the roller 3 and the clamping bar 46 rest on the strip 63. The adjusting according to the thickness of the strip, depending from a respective strip to be processed in the punch press, proceeds exclusively at the adjusting nut 45 such as described earlier.

Because the rocker 30 is supported in an overhung state on a cantilever, it is possible to produce with two of the described feeding apparatuses a twin feeding apparatus in that two such feeding apparatuses are arranged so that they face each other.

Figure 6:
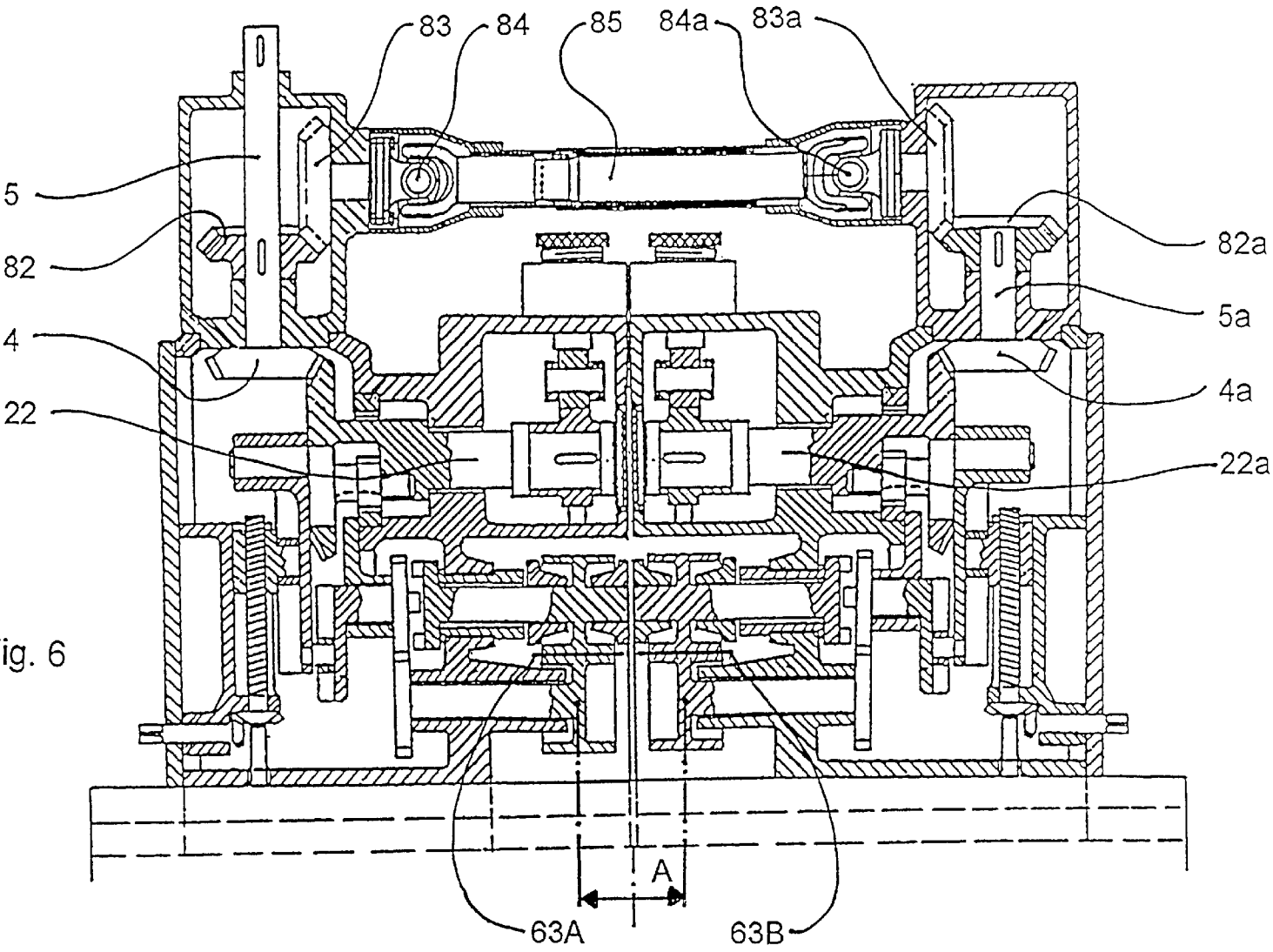
FIG. 6 illustrates a section through a twin design embodiment for a feeding of two strip-shaped articles.

A first embodiment of a twin feeding apparatus is illustrated in FIG. 6.

The design of the two individual single feeding apparatuses is the same as the design of the feeding apparatus described with reference to FIGS. 1 and 2, so that in the following only those structural members must be described which are specific to the twin feeding apparatus.

The feeding apparatus located in FIG. 6 at the left includes the shaft 5 which is coupled to a drive, which shaft 5 is mounted to the bevel gear wheel 4 acting as driving member.

A further bevel gear wheel 82 is located on the shaft 5. This bevel gear wheel 82 meshes with a bevel gear wheel 83. The bevel gear wheel 83 which is coupled to a first universal joint 84 which is followed by a telescope-like length adjustable drive transmission shaft 85 which is coupled to a second universal joint 84*a*, which in turn is coupled to a bevel gear wheel 83*a* of the feeding apparatus located at the right side. This bevel gear wheel 83*a* meshes with a bevel gear wheel 82*a* which sits on the drive shaft 5*a* and meshes with the bevel gear wheel 4*a*.

Accordingly, the two individual feeding devices of the twin feeding apparatus are simultaneously driven in synchronism from a drive common to both through the shaft 5.

By means of this twin feeding apparatus it is now possible to feed or advance, resp. at the same time two sheet metal strips 63A and 63B. Thus, the two sheet metal strips 63A and 63B can be fed independently but in synchronism regarding the angular movement of the feeding rollers of the twin feeding apparatus. However, with regard to their thickness, their width, the length of the feeding steps and also regarding the material these strips 63A and 63B can be completely different from each other. It is, obviously, also possible to operate with one single strip only, which strip is engaged at both its side edge areas by the feeding rollers of the two individual feeding apparatuses.

Figure 7:
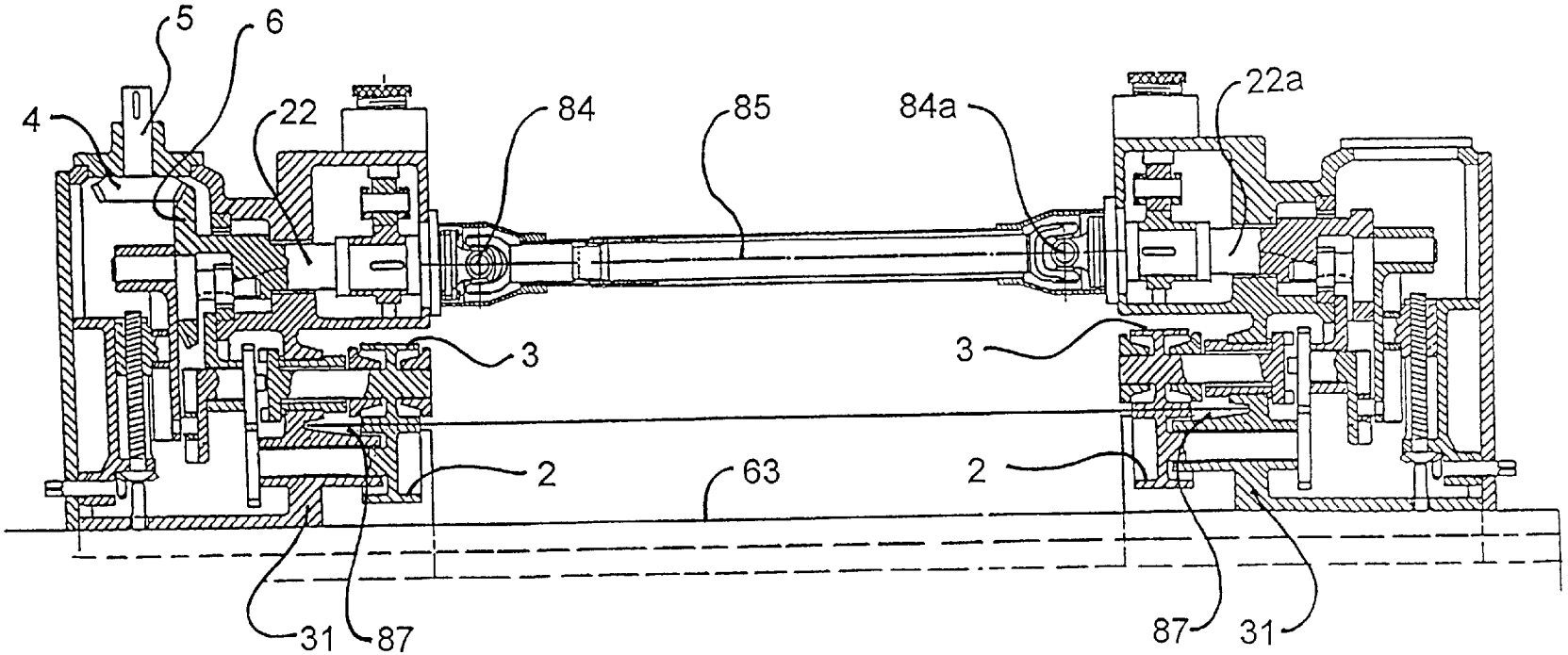
FIG. 7 illustrates a section through a twin design embodiment for a feeding of an extremely broad strip-shaped article.

FIG. 7 illustrates a embodiment of a twin feeding apparatus which finds application for extremely large strip widths. Again, only those structural members are described which are specific to this twin feeding apparatus.

The feeding apparatus located in FIG. 7 at the left side includes the shaft 5 which is adapted to be coupled to a drive and which is mounted to the bevel gear wheel 4. This bevel gear which 4 meshes as described earlier with the further bevel gear wheel 6. This further bevel gear wheel 6 sits on the drive shaft 22.

The drive shaft 22 is coupled to a first universal joint 84 which is followed by a telescope-like length adjustable drive transmission shaft 85 which is followed by a second universal joint 84*a*. This second universal joint 84*a* is directly connected to the feeding apparatus located in FIG. 7 at the right side.

This twin feeding apparatus can handle strips having a extremely large width.

The first lower feeding roller is supported in a overhung state at the corresponding supporting portion 31 of the frame 1. It now is to be noted that this supporting portion 31 has a recess 87 into which the edge area of the strip to be fed projects. This recess 87 is important for the feeding of individual single strips, see FIGS. 1 and 6. It determines the maximal strip width. The dimension A in FIG. 6 determines the minimal distance between two strips. This dimension A is among others of a large importance regarding the space requirements of a punch press and only possible due to the "overhung" rocker.

While there are shown and described presently preferred embodiments of the invention, it is to be distinctly understood that the invention is not limited thereto but may be otherwise variously embodied and practiced within the scope of the following claims.

What is claimed is:

1. An apparatus for stepwise feeding strip-shaped material, comprising a frame; and an arrangement for stepwise feeding of a strip-shaped article comprising:

first and second feeding rollers adapted to receive between them a strip-shaped article to be fed;

means for driving said first and second feeding rollers to oscillate in contrarotating direction;

a rocker having first and second opposite ends;

said first feeding roller being supported for rotation in said frame in a Non displaceable state, said second feeding roller being supported for rotation in said rocker;

means for moving said rocker and said second feeding roller therewith towards said first feeding roller in a feeding position and away from said first feeding roller in a return position;

said means for moving said rocker including a control means which communicates with said means for driving said feeding rollers and includes a translatory moveable rod member guided for an upwards and downwards movement, said rod member being mounted to said first end of said rocker and adapted to move said rocker together with said second feeding roller supported therein, at a point in time of a reversal of a first direction of rotation of the oscillating feeding rollers, to said feeding position, and at a point of time of a reversal of a second direction of rotation of the feeding rollers to said return position;

said second feeding roller having an axis;

a first pressure spring having a first end resting on said rocker at a point between said axis of said second feeding roller and said second end of said rocker, said first pressure spring having a second end opposite said first end resting on said frame, said first pressure spring acting on said rocker from the same side as said rod member and in a direction substantially parallel to a direction of movement of said rod member;

a clamping bar mounted to said rocker and a stationary clamping bar counter member arranged at said frame, said clamping bar being biased by said first pressure spring against said stationary counter member in order to arrest a respective strip-shaped article when said second feeding roller is in its return movement position, and is lifted off said stationary counter member when said second feeding roller is in its feeding movement position;

said rocker being supported at one side thereat for rotation on a cantilever structure which in turn is supported in said frame for rotation in a non displaceable state, said cantilever structure comprising a sleeve supported for free rotation in said frame, said sleeve having a laterally projecting arm supporting a shaft which extends parallel to said sleeve and is held in said arm in a releasably clamped state, and wherein said rocker is supported for rotation on said shaft, said shaft being held in a slotted end portion of said arm, and wherein threaded bolts extend through said slotted end portion to hold said shaft in the clamped state in said arm.

2. The apparatus of claim 1, wherein said means for driving said feeding roller includes a driving member which is drivingly connected to a driving gear wheel, and includes a disk which is arranged eccentrically and freely rotatable inside said driving gear wheel, and includes a pivot pin projecting from one side of said disk, which disk is connected at the opposite side to a spur gear wheel coaxially to said pivot pin, which spur gear wheel meshes with a ring arranged stationary in said frame and having an internal toothing, and includes a pivotable arm supported at one end of said pivot pin and connected at its opposite end through an arm to a drive transmitting shaft which is connected through a coupling to said second feeding roller and through gear wheels to said first feeding roller, which pivotable arm is further supported for rotation at a point between its two ends at a guiding block.

3. The apparatus of claim 2, wherein said guiding block is guided displaceably in said frame.

4. The apparatus of claim 3, comprising a threaded spindle which extends through said guiding block.

5. The apparatus of claim 1, wherein said first feeding roller is supported in a supporting portion of said frame in an overhung state.

6. The apparatus of claim 5, wherein said supporting portion of said frame includes a recess which is aligned with a bite of said two feeding rollers, which recess is adapted to receive an edge portion of s atrip-shaped article located between said feeding rollers.

7. The apparatus of claim 1, wherein said rocker is supported at its end which is connected to said rod member on a second pressure spring which in turn rests against said frame and acts in a direction coinciding with the direction of movement of said rod member and opposite the direction of action of said first pressure spring.

8. The apparatus of claim 1, and comprising a clamping bar lifting-off means which coacts with said rocker and is adapted to be switched on and off, and in its switched on state is operative to lift said clamping bar off said stationary counter member when said second feeding roller is lifted off said first feeding roller, which clamping bar lifting-off means includes a control rod having an abutment head which control rod is located at said second end of said rocker adjacent to said first pressure spring, which abutment head engages into said rocker, and which control rod is pivotally mounted to a arm of a bell crank lever supported for rotation in said frame, of which another arm is connected to an arresting means adapted to selectively arrest said bell crank lever or to release same for rotation.

9. The apparatus of claim 8, wherein said arresting means includes a piston located in a chamber, which piston has a free surface which communicates with a source of a pressurized medium.

10. The apparatus of claim 9, wherein said abutment head is located in a recess with a collar formed in said rocker at its second end, which abutment head contacts said collar, when in the bell crank lever arresting state.

11. The apparatus of claim 1, wherein said control means includes a pivotable lever supported on a pivot pin, which pivotable lever is pivotally mounted to said translatory moveable rod member and contacts a control cam arranged on a drive shaft, which pivotable lever cooperates with said translatory moveable rod member and said control cam, which control cam is operative to determine in dependency from its rotational position the position of the pivotable lever supported on said pivot pin.

12. The apparatus of claim 11, comprising an adjusting means for an adjusting the position of said pivot pin and of a pivot axis of said pivotable lever in order to adjust the distance between said two feeding rollers in their feeding position.

13. The apparatus of claim 12, wherein said adjusting means includes a piston which is connected to said pivot pin of said pivotable lever in order to lift or lower said pivot pin substantially in the direction of movement of said translatory moveable rod member.

14. The apparatus of claim 1, wherein said second feeding roller has a feeding shaft extending along said axis of the second feeding roller, said rocker being rotatably supported at an end portion of said feeding shaft.

15. The apparatus of claim 14, wherein said feeding shaft extends coaxially with play in said sleeve for free radial movement therein.

16. The apparatus of claim 1, further comprising a second said arrangement for stepwise feeding a second strip-shaped article, said second arrangement being supported by said frame to form a twin feeding device in which the respective first and second feeding rollers of the first and second said arrangements face one another and a common drive means for driving the first and second feeding rollers of the first and second arrangements for feeding the respective strip-shaped articles.

17. The apparatus of claim 16, wherein both said first and second arrangements comprise a drive member which is coupled to a drive shaft of the control means of the means for moving the rocker, and wherein a driving gear of one of the first and second arrangements is mounted to a shaft adapted to be coupled to a drive motor, and is drivingly coupled through drive members including a drive transmitting shaft to a driving gear of the other of the first and second arrangements.

18. The apparatus of claim 16, wherein the control means of the means for moving the rocker of both of the first and second arrangements has a drive shaft, the drive shaft of one of the first and second arrangements being coupled to a driving gear which is mounted to a shaft adapted to be coupled to a drive motor, and wherein said drive shaft of said one of the first and second arrangements is drivingly coupled to the drive shaft of the other of the first and second arrangements through a drive transmitting shaft.

19. The apparatus of claim 16, wherein said first and second feeding rollers of the first and second arrangements are in immediate proximity to one another without said frame intervening therebetween.

* * * * *